US007074063B1

(12) United States Patent
Bailey et al.

(10) Patent No.: US 7,074,063 B1
(45) Date of Patent: Jul. 11, 2006

(54) JUNCTION BOX ASSEMBLY

(75) Inventors: Matthew P. Bailey, Redford, MI (US); Damon T. Malone, Canton, MI (US); Robert J. Valascho, Jr., Royal Oak, MI (US)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 11/089,008

(22) Filed: Mar. 24, 2005

(51) Int. Cl.
*H01R 13/62* (2006.01)

(52) U.S. Cl. ..... 439/157; 439/372

(58) Field of Classification Search ..... 439/157, 439/153, 152, 372, 342, 347, 160, 159, 76.2, 439/949
See application file for complete search history.

(56) References Cited

U.S. PATENT DOCUMENTS

| | | | | |
|---|---|---|---|---|
| 6,500,015 | B1 * | 12/2002 | Fukamachi et al. | 439/157 |
| 6,739,889 | B1 | 5/2004 | Daggett et al. | |
| 6,926,545 | B1 * | 8/2005 | Fukamachi et al. | 439/157 |
| 2003/0211764 | A1 | 11/2003 | Fukamachi et al. | |

* cited by examiner

*Primary Examiner*—Tho D. Ta
*Assistant Examiner*—Felix O. Figueroa
(74) *Attorney, Agent, or Firm*—Oliff & Berridge, PLC

(57) ABSTRACT

A junction box assembly includes a junction box housing and a connector assembly. Connectors in the junction box housing mate with corresponding connectors in the connector assembly. First cams are provided for the mating pairs of connectors to facilitate engagement of the connectors. Second cams are provided at positions other than on the connectors, to facilitate engagement of the junction box housing and the connector assembly. The first and second cams reduce the required force necessary to press the junction box housing and the connector assembly into engagement with each other.

12 Claims, 7 Drawing Sheets

JUNCTION BOX ASSEMBLY

BACKGROUND

This invention relates to a junction box assembly, such as an electrical connection box assembly mounted on a vehicle or the like.

In various assembly processes, such as automobile assembly processes, many cable connections must be made, e.g., within the electrical system of a vehicle. Connections are often made using connectors, such as plug-in-type connectors.

SUMMARY

When a connector contains only a few, e.g., two to four, conductors to be coupled with corresponding conductors of another connector, relatively low force is required to push the connectors together so that the respective conductors engage. However, as the number of conductors in each connector increases, the force required to connect the connectors also increases. Additionally, in some assemblies, a plurality of connectors are ganged together and connected to a corresponding plurality of connectors, which also increases the force required to push the connectors together.

Force multiplying technology has been applied to connectors to reduce the actual force that must be applied by a human operator to connect connectors together. For example, U.S. Pat. No. 6,500,015 and U.S. Patent Application Publication No. US 2003/0211764 disclose systems in which rotating levers, also called cams, with cam grooves are provided on a first connector, and a mating corresponding connector is provided with follower pins that interact with the cam grooves. The cams also include a connection pin provided at an end of the cam opposite from an end containing the cam groove. This connection pin interacts with a connection groove provided in a holder that holds the first connector. When the two connectors are pushed together, the cams, follower pins and connection pins provide a force multiplying effect, which reduces the force required to push the connectors together.

However, as systems are designed that require even more conductors per connector, and/or the ganging together of even more connectors for simultaneous assembly to mating connectors, it is desirable to provide systems and methods for further reducing assembly forces, to reduce the occurrence and/or severity of assembly operator fatigue.

Embodiments of this invention address this need by providing cams both at the connectors and at other locations on a housing surrounding the connectors.

These and other objects, advantages and salient features of the invention are described in or apparent from the following description of embodiments.

BRIEF DESCRIPTION OF THE DRAWINGS

Exemplary embodiments will be described with reference to the accompanying drawings, in which like numerals represent like parts, and wherein.

DETAILED DESCRIPTION OF EMBODIMENTS

Figure 1:
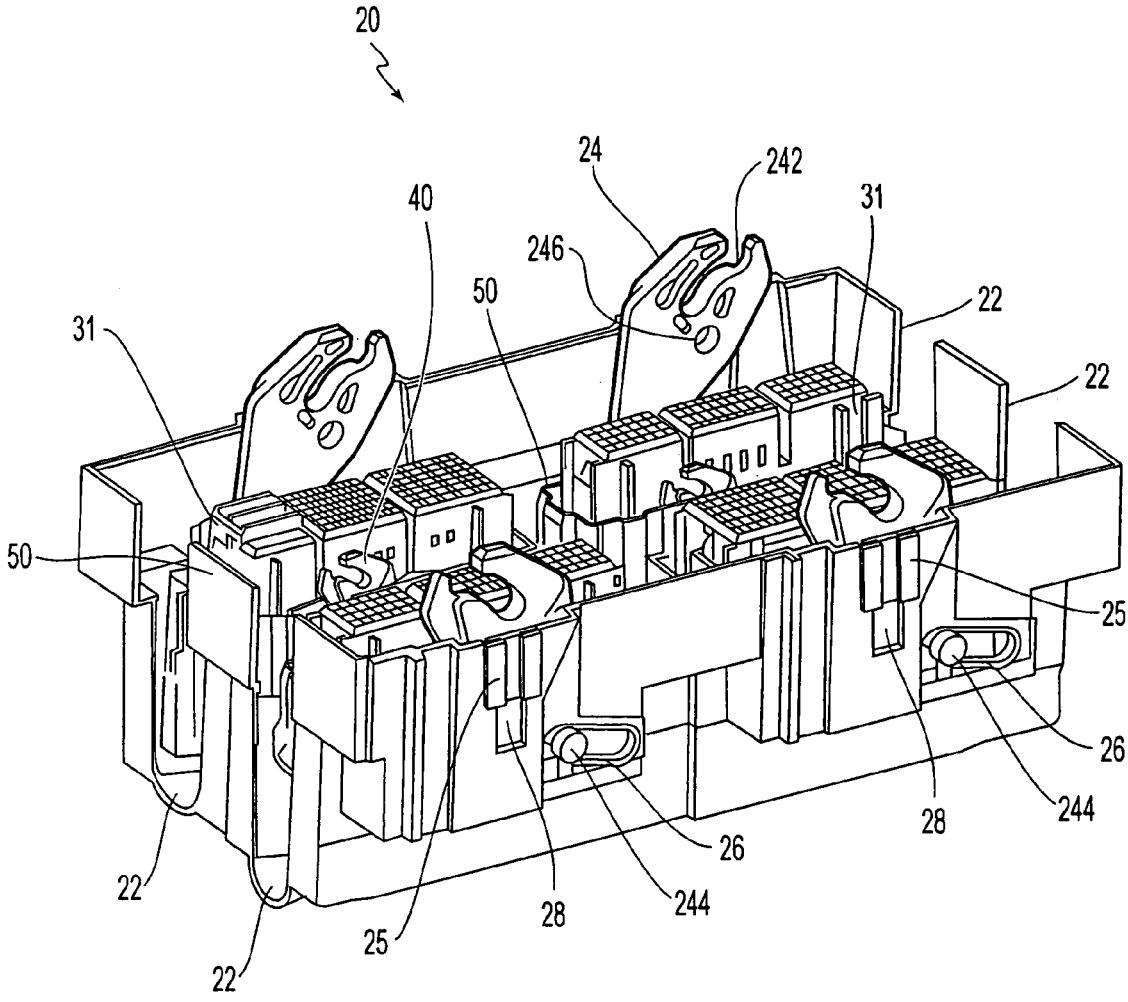
FIG. 1 is a perspective view of a junction box housing.

FIG. 1 illustrates a junction box housing 20 according to an exemplary embodiment of the invention. The junction box housing 20 includes a plurality of connectors 31, which are slidably held in holders 50. An exemplary structure by which the connectors 31 may be held in holders 50 is disclosed in related copending U.S. application Publication No. US 2003/0211764 A1, the disclosure of which is incorporated herein by reference in its entirety. Cams 40 are pivotally connected to each connector 31. Preferably, one cam is provided on each side of each connector 31.

Cable slots 22 are provided in the exterior wall of the junction box housing 20, so that, e.g., electrical cables of a wiring harness (not depicted) can pass from outside the junction box housing 20 to the connectors 31 located within the junction box housing 20. Preferably, the cable slots 22 have an open end, as depicted, so that a cable may be slid into place in the slot 22 even while a connector 31 is attached to an end of the cable.

The junction box housing 20 also includes cams 24 attached to the junction box housing 20 at locations other than the connectors 31. Four identical cams 24 are depicted in this embodiment. As shown in FIG. 1, in this embodiment, the cams 24 are pivotally connected, via pivot shafts 246, to sliders 25 that slide up and down within slots 28 provided in a wall of the junction box housing 20.

An upper end of each cam 24 includes a cam groove 242, and a lower end of each cam 24 includes a cam pin 244. The cam pins 244 engage with slots 26 provided in a wall of the junction box housing 20. As discussed in more detail hereafter, as the sliders 25 move downward within the slots 28, the cams 24 rotate about the pivot shafts 246, and the cam pins 244 move from one end of the slots 26 toward the other end of the slots 26.

Figure 2:
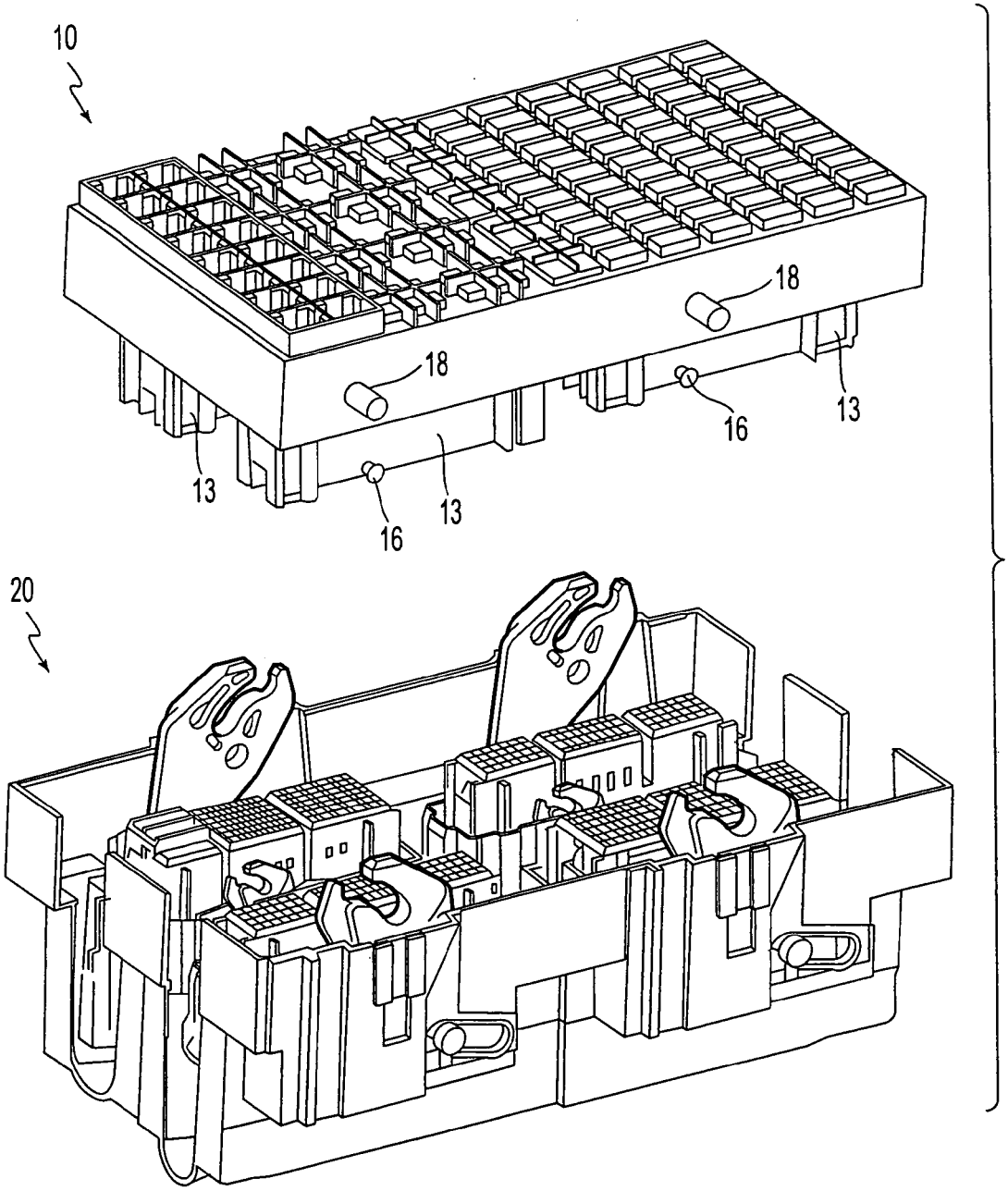
FIG. 2 is an exploded perspective view of a junction box housing and a connector assembly that attaches to the junction box housing.

FIG. 2 shows the junction box housing 20 and a connector assembly 10 that connects to the junction box housing 20 to form a junction box assembly. The connector assembly 10 includes connectors 13 that mate with the connectors 31 of the junction box housing 20. The connectors 13 include cam-engaging pins 16 that engage the cams 40, and the connector assembly 10 also includes cam-engaging pins 18 that engage the cams 24.

At an upper surface of the connector assembly 10, relays, fuses and/or other electrical devices may be installed as appropriate to make various desired connections between terminals of the connectors 13. An upper cover (not shown) may be attached to the connector assembly by snap-lock mechanisms, screws or the like to protect the electrical components of the connector assembly 10.

Figure 3:
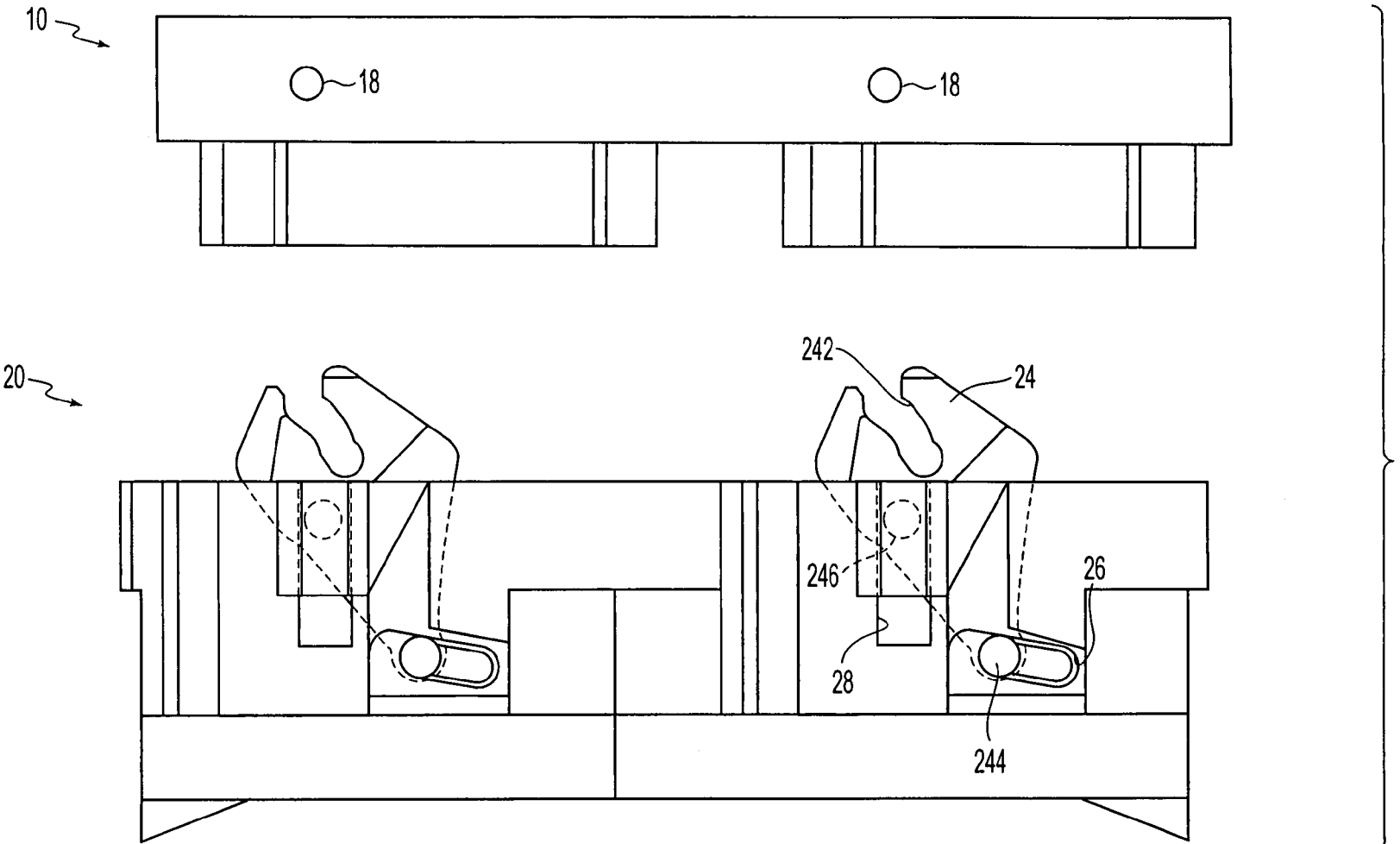
FIG. 3 is an elevation view that illustrates a junction box housing and a connector assembly prior to engagement.

FIG. 3 illustrates the junction box housing 20 and the connector assembly 10 prior to engagement.

Figure 4:
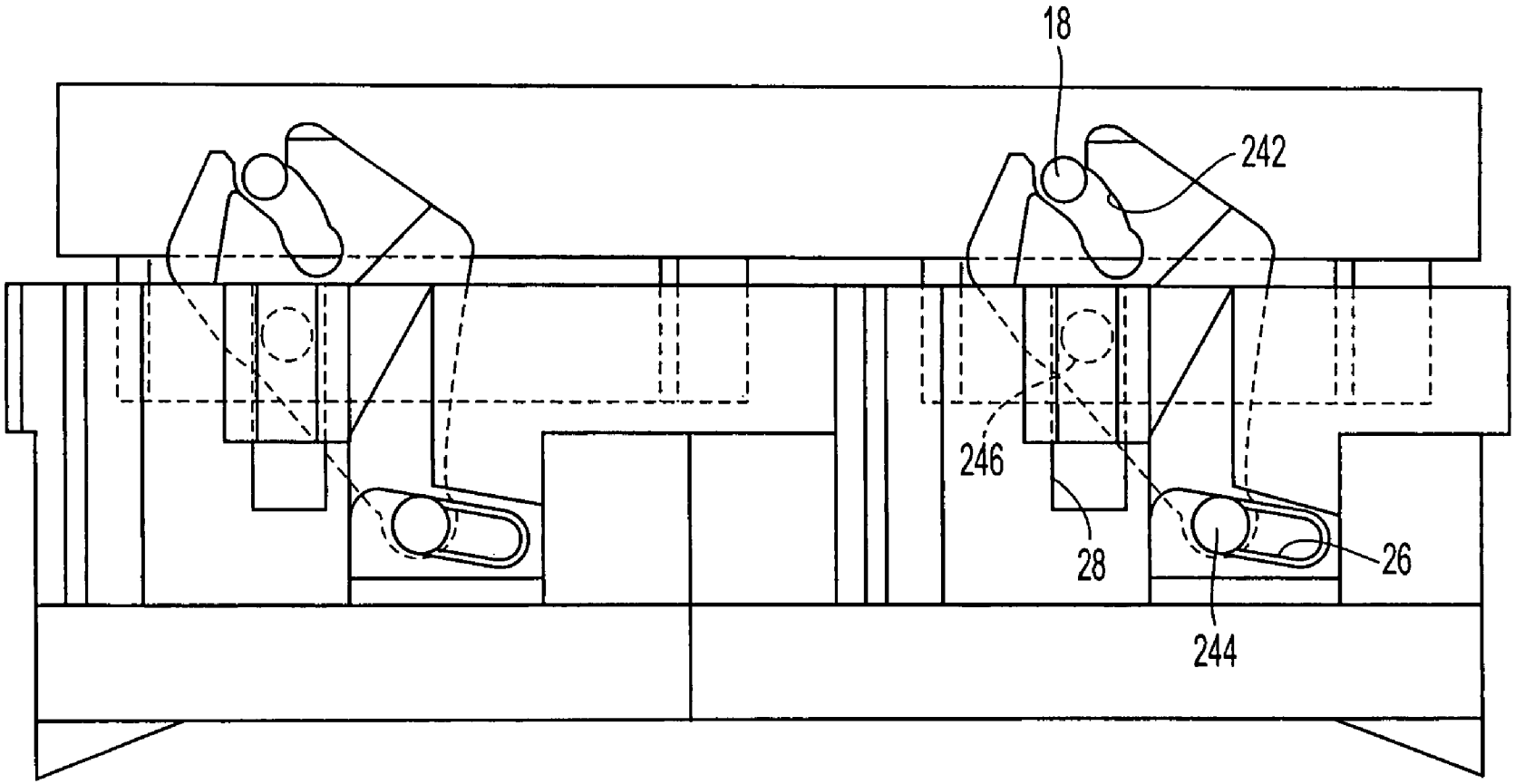
FIG. 4 is an elevation view that illustrates an initial engagement state of the junction box housing and connector assembly of FIG. 3.

As shown in FIG. 4, when the connector assembly 10 is brought into initial engagement with the junction box housing 20, the cam-engaging pins 18 engage cam grooves 242 of the cams 24.

Figure 5:
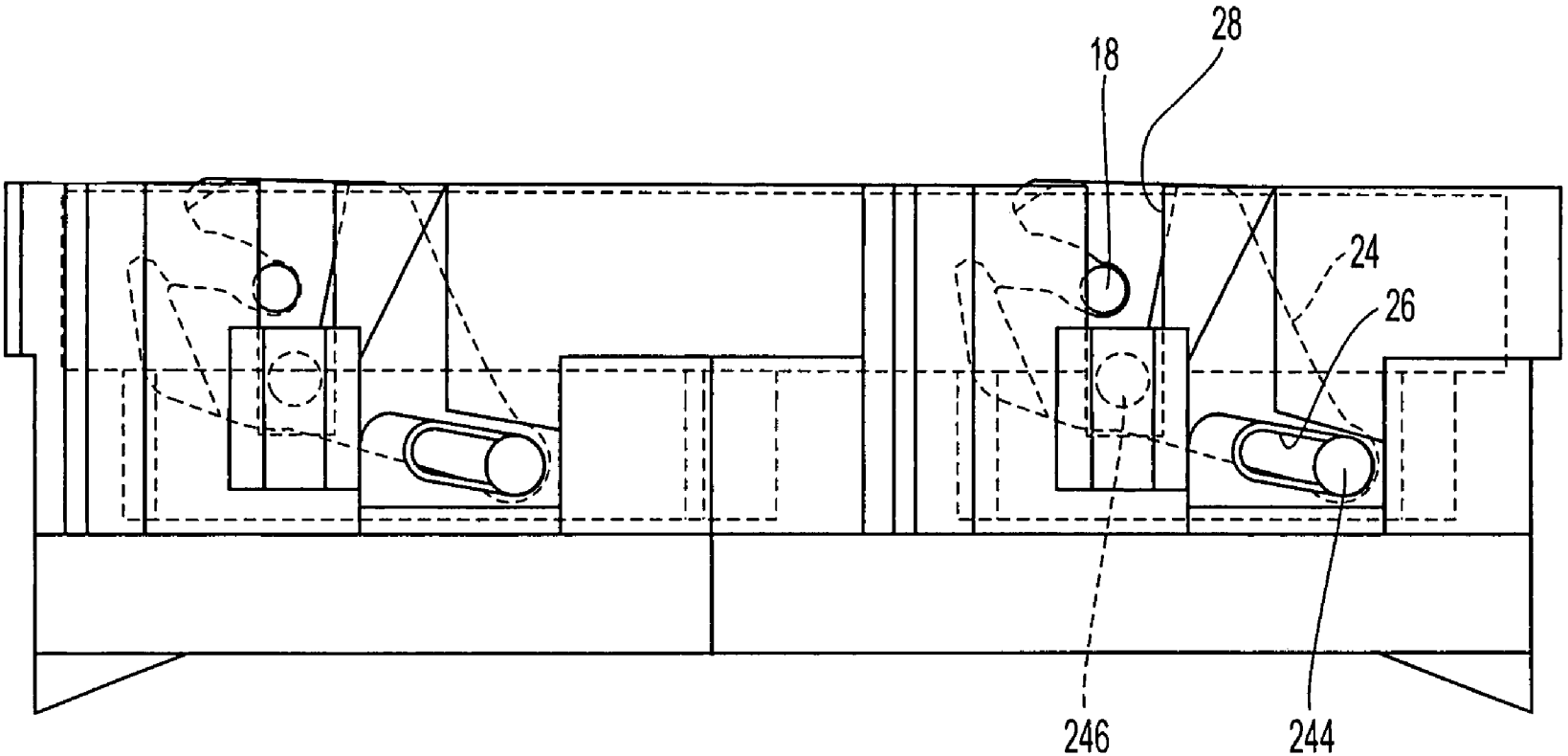
FIG. 5 is an elevation view that illustrates a fully connected state of the junction box housing and connector assembly of FIG. 3.

As shown in FIG. 5, as the connector assembly 10 proceeds to its final engagement position with respect to the junction box housing 20, the cams 24 rotate, the sliders 25 move downward, the cam-engaging pins 18 move toward closed ends of the cam grooves 242, and the cam pins 244 move toward other ends of the slots 26 (rightward in FIG. 5). During this action, a force multiplying effect is generated by the interaction of the cam-engaging pins 18, cam grooves 242, pivot shafts 246, cam pins 244 and slots 26. This force multiplying effect reduces the actual force necessary to push the connector assembly 10 into engagement with the junction box housing 20.

One or more snap-lock mechanisms, screws or the like (not shown) may be provided to positively lock the connector assembly 10 into engagement with the junction box housing 20 when the connector assembly 10 reaches its final engagement position with respect to the junction box housing 20.

Figure 6:
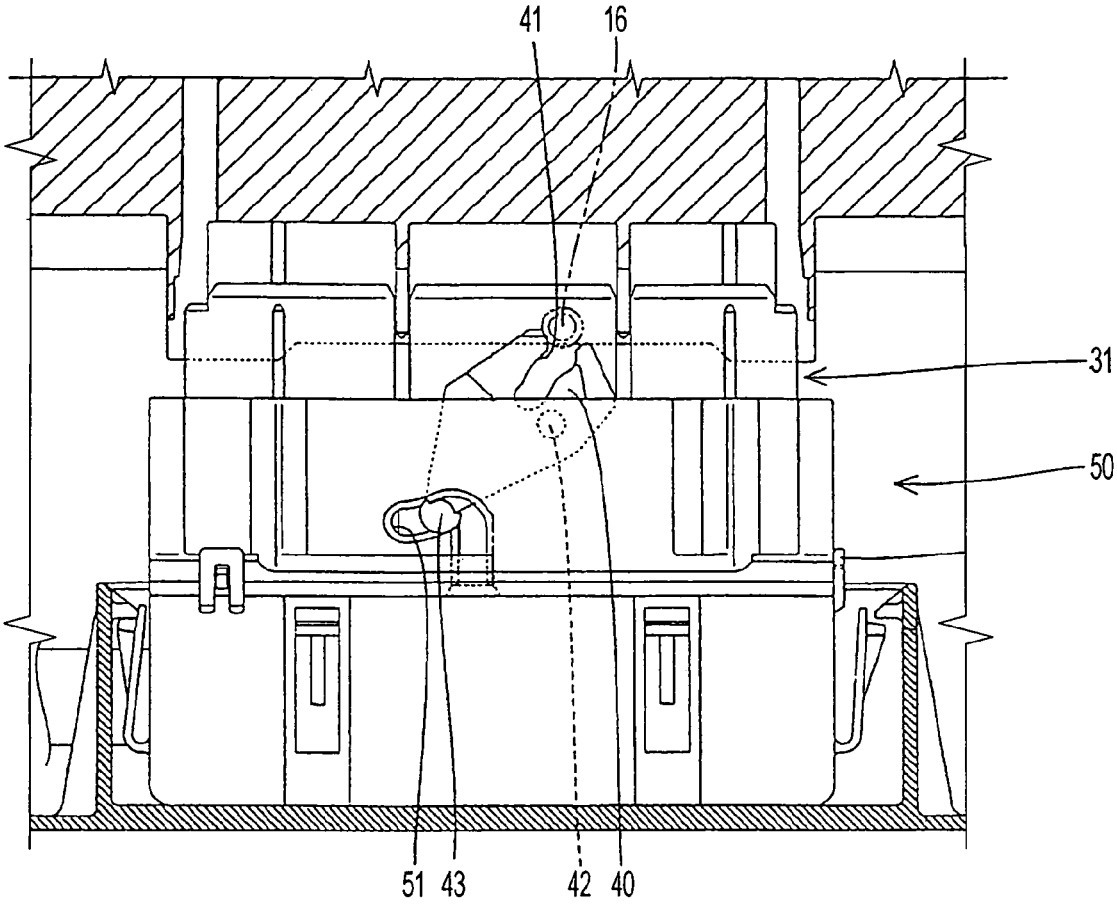
FIG. 6 is an elevation view that illustrates an initial engagement state of connectors within a junction box housing and connector assembly.
Figure 7:
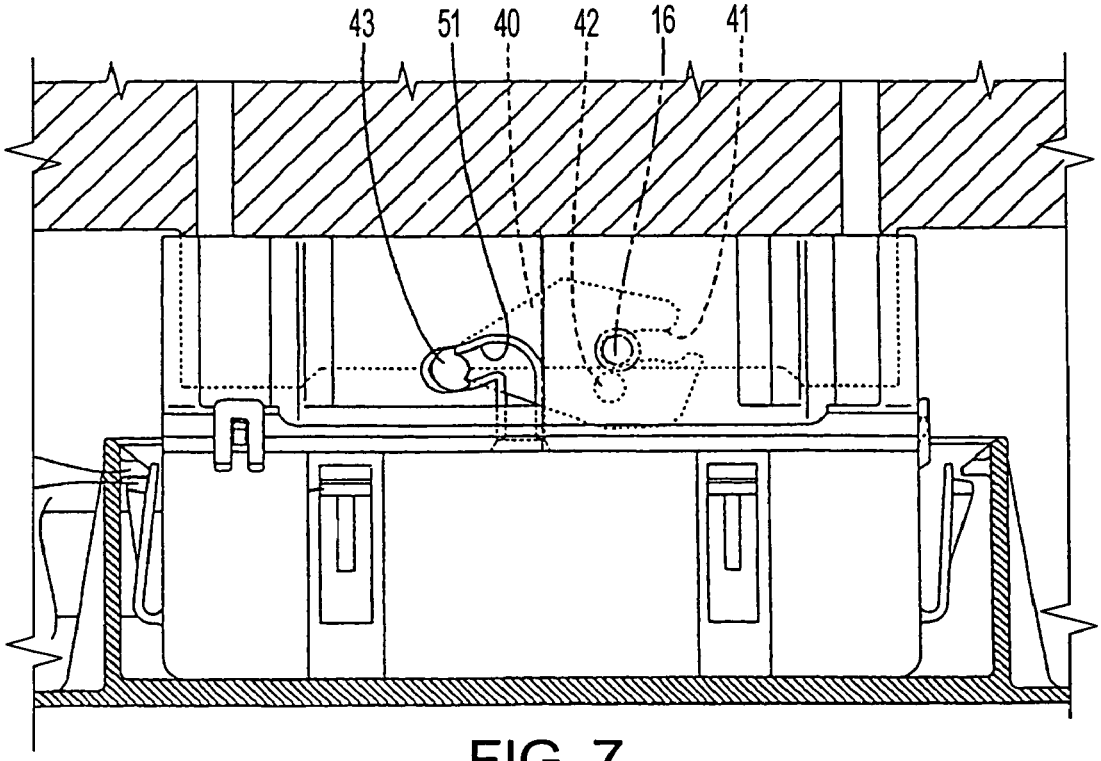
FIG. 7 is an elevation view that illustrates a fully engaged state of the connectors illustrated in FIG. 6.

FIGS. 6 and 7 respectively show initial and final stages of engagement between the connectors 31 on the junction box housing 20 side and the connectors 13 on the connector assembly side. The operation of the cams 40 during this engagement is similar to that of the cams 24 during engagement of the connector assembly 10 and the junction box housing 20, described above. Specifically, the cam-engaging pins 16 engage cam grooves 41 of the cams 40 as shown in FIG. 6, and as the connectors proceed to the fully engaged state shown in FIG. 7, the cams 40 rotate about pivot shafts 42, the cam-engaging pins 16 move toward a closed end of the cam grooves 41, and cam pins 43 affixed to the cams 40 move toward a closed end of slots 51 provided in the holders 50. As the cams 40 rotate, the connectors 31 are pressed into the holders 50.

Like the action of the cams 24, the action of the cams 40 produces a force multiplying effect, which makes it easier to press the connectors into their fully engaged state.

Because cams are provided both at the connectors and at positions other than connectors in the junction box, the force required to assemble the connectors into a fully engaged state can be reduced compared to that required in previous structures. Accordingly, operator fatigue can be reduced or avoided.

While the invention has been described in conjunction with specific embodiments, these embodiments should be viewed as illustrative and not limiting. Various changes, substitutes, improvements or the like are possible within the spirit and scope of the invention.

For example, the number of mating connector pairs is not limited to the four depicted, but may be any number, including one. The number of cams 24 is not limited to the four depicted, but may be any number, including one. However, it is preferable that the number of cams be an even number, so that forces can be balanced on opposite sides of the assembly.

As another example, the location of the cams 24 is not limited to the exterior wall of the junction box housing 20, but may be at an interior wall or other support structure provided inside the junction box housing 20, for example.

As another example, any of the depicted interacting parts may be reversed; e.g., the cams 24 may be provided on the connector assembly 10, and the cam-engaging pins 18 may be provided on the junction box housing 20. Similarly, the cams 40 may be provided on the connectors 13, and the cam-engaging pins 16 may be provided on the connectors 31.

What is claimed is:

1. A junction box assembly, comprising:

a junction box housing holding one or more first connectors;

a connector assembly holding one or more second connectors that mate with the one or more first connectors;

one or more first cams, each provided on one of the first connectors or on one of the second connectors;

one or more first cam-engaging pins, each provided on one of the first connectors or on one of the second connectors, such that the first cam-engaging pins engage the first cams when the first connectors are connected to the second connectors;

one or more second cams provided on the junction box housing at a position other than on the first connectors, or on the connector assembly at a position other than on the second connectors; and one or more second cam-engaging pins provided on the junction box housing or on the connector assembly at a location such that the second cam-engaging pins engage the second cams when the connector assembly is engaged with the junction box housing;

wherein the first cams and the second cams reduce a force necessary to press the connector assembly and the junction box housing into engagement.

2. The junction box assembly according to claim 1, wherein there are at least two of the first connectors and at least two of the second connectors.

3. The junction box assembly according to claim 1, wherein two of the first cams are provided with respect to each mating connector pair.

4. The junction box assembly according to claim 1, wherein there are at least two of the second cams.

5. The junction box assembly according to claim 4, wherein there are four of the second cams.

6. The junction box assembly according to claim 1, wherein the second cams are rotatably supported on sliders that slide with respect to the junction box housing, in a direction parallel to a direction of engagement of the connectors.

7. A junction box assembly, comprising:

a junction box housing holding one or more first connectors;

a connector assembly holding one or more second connectors that mate with the one or more first connectors;

one or more first cams, each provided on one of the first connectors or on one of the second connectors;

one or more first cam-engaging pins, each provided on one of the first connectors or on one of the second connectors, such that the first cam-engaging pins engage the first cams when the first connectors are connected to the second connectors;

one or more second cams provided on the junction box housing at a position other than on the first connectors; and one or more second cam-engaging pins provided on the connector assembly at a location such that the second cam-engaging pins engage the second cams when the connector assembly is engaged with the junction box housing;

wherein the first cams and the second cams reduce a force necessary to press the connector assembly and the junction box housing into engagement.

8. The junction box assembly according to claim 7, wherein there are at least two of the first connectors and at least two of the second connectors.

9. The junction box assembly according to claim 7, wherein two of the first cams are provided with respect to each mating connector pair.

10. The junction box assembly according to claim 7, wherein there are at least two of the second cams.

11. The junction box assembly according to claim 10, wherein there are four of the second cams.

12. The junction box assembly according to claim 7, wherein the second cams are rotatably supported on sliders that slide with respect to the junction box housing, in a direction parallel to a direction of engagement of the connectors.

* * * * *